United States Patent [19]

Goldfarb et al.

[11] Patent Number: 4,652,247

[45] **Date of Patent: * Mar. 24, 1987**

[54] AMPHIBIOUS SELF-POWERED TOY VEHICLE WITH INTEGRATED FOUR-WHEEL AND STEERING-WATER-JET DRIVE

[75] Inventors: Adolph E. Goldfarb, 1432 SE. Wind Cir., Westlake Village, Calif. 91361; Delmar K. Everitt, Morro Bay, Calif.

[73] Assignee: Adolph E. Goldfarb, Westlake Village, Calif.

[ * ] Notice: The portion of the term of this patent subsequent to Dec. 22, 1998 has been disclaimed.

[21] Appl. No.: 788,052

[22] Filed: Oct. 16, 1985

Related U.S. Application Data

[63] Continuation-in-part of Ser. No. 463,999, Feb. 4, 1983, Pat. No. 4,547,166, which is a continuation-in-part of Ser. No. 417,554, Sep. 13, 1982, Pat. No. 4,492,058, which is a continuation-in-part of Ser. No. 233,495, Feb. 11, 1981, abandoned, which is a continuation-in-part of Ser. No. 121,645, Feb. 14, 1980, Pat. No. 4,306,375.

[51] Int. Cl.[4] ..... A63H 23/04; A63H 29/24

[52] U.S. Cl. ..... 446/164; 446/463

[58] Field of Search ..... 446/160, 164, 163, 165, 446/153, 154, 462, 457, 463

[56] References Cited

U.S. PATENT DOCUMENTS

| | | | |
|---|---|---|---|
| 4,511,343 | 4/1985 | Goldfarb et al. | 446/463 |
| 4,540,376 | 9/1985 | Turbowitz et al. | 446/164 |
| 4,547,166 | 10/1985 | Goldfarb et al. | 446/164 |

FOREIGN PATENT DOCUMENTS

| | | | |
|---|---|---|---|
| 960860 | 1/1975 | Canada | 446/457 |
| 647628 | 10/1962 | Italy | 446/164 |

*Primary Examiner*—Mickey Yu

*Attorney, Agent, or Firm*—Romney, Golant, Martin, Seldon & Ashen

[57] ABSTRACT

This toy propels itself along the surface of a pool of water or along an extremely steep, irregular nonwater surface. A battery powers a motor, which drives the vehicle's four wheels and a steerable water jet. The wheels carry pronounced peripheral cleats for propulsion along both a water surface and a very steep, irregular nonwater surface. The hollow wheels, several times overscale, contribute significantly to overall buoyancy. The water-jet impeller aids propulsion along a water surface and can be rotated horizontally to direct the vehicle in circles of variable diameter. The motor shaft is aligned with the direction of vehicle travel and extends both forwardly and rearwardly from the motor to drive a symmetrical geartrain for nonwater-surface propulsion: fixed on each shaft end is a pinion that drives a spur gear, which in turn drives a worm, that in its turn drives a worm gear keyed to an axle. The worm gear drives the axle, which drives the wheels and tires. The forward and rearward ends of the motor shaft drive the front and rear wheels respectively; the rearward end also drives the water jet, through an extension of the rear pinion and a crown gear fixed to the water-jet impeller. A shifting bar is also provided in the vehicle for manual shifting of the worm gears in and out of mesh with the worms.

9 Claims, 8 Drawing Figures

FIG. 2
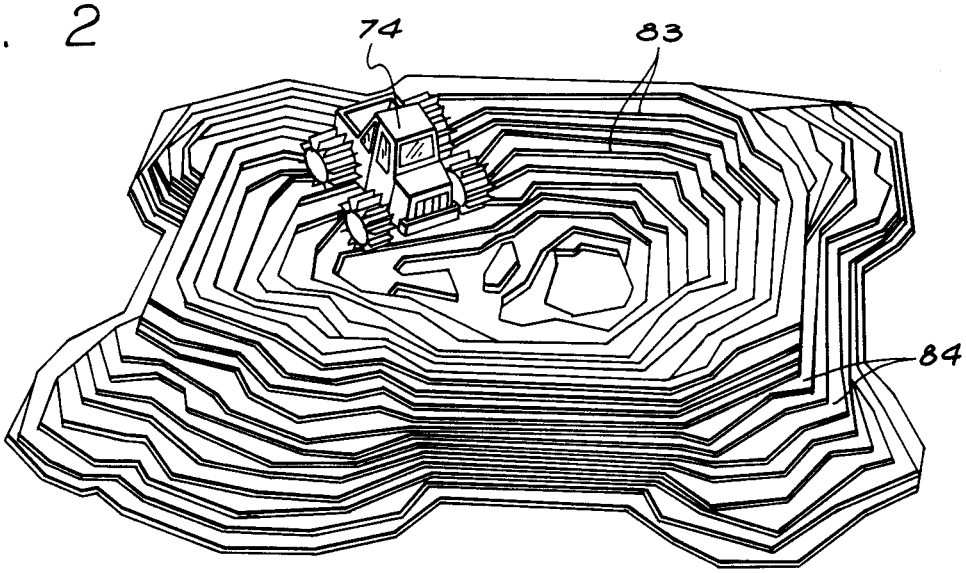
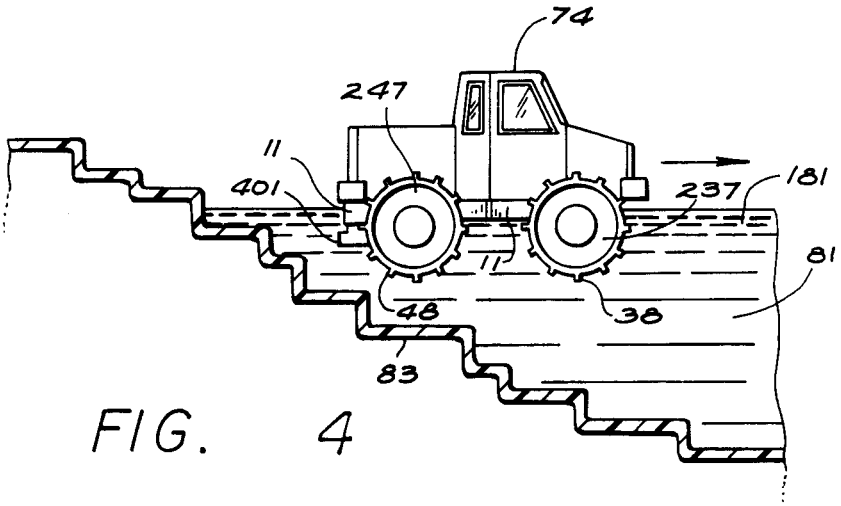
FIG. 4
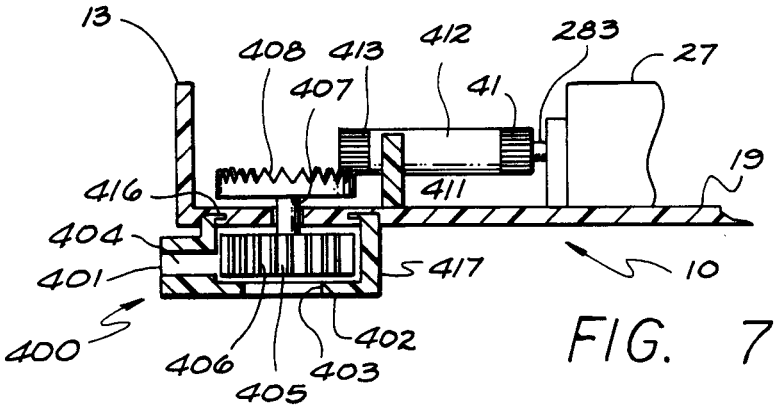
FIG. 7

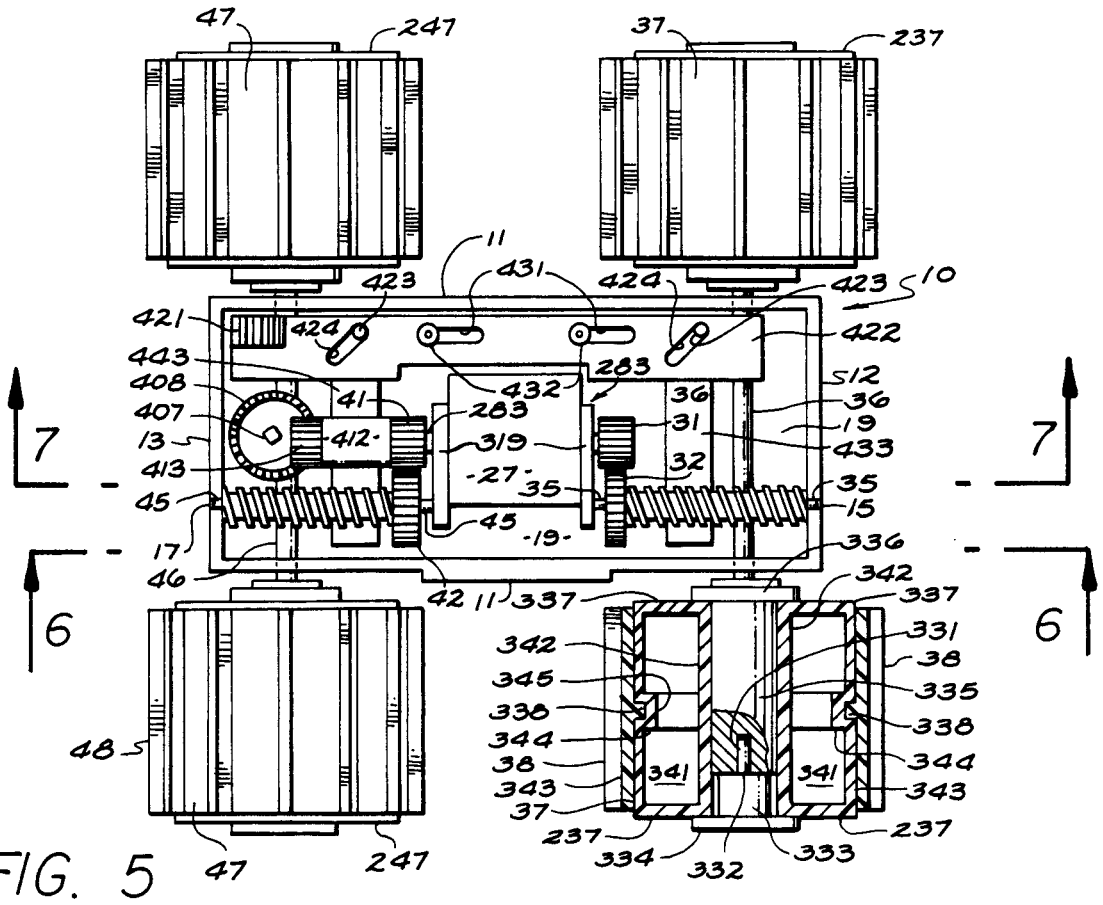
FIG. 5
FIG. 6
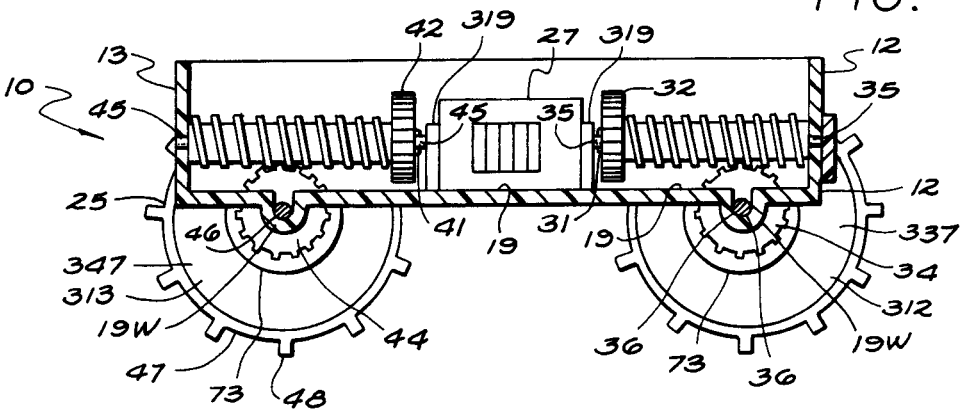
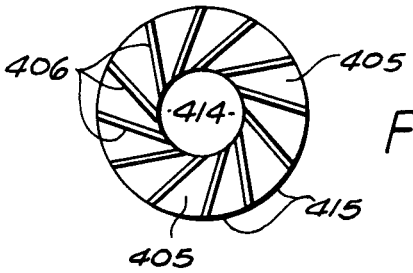
FIG. 8

AMPHIBIOUS SELF-POWERED TOY VEHICLE WITH INTEGRATED FOUR-WHEEL AND STEERING-WATER-JET DRIVE

RELATED APPLICATIONS AND PATENT

This application is a continuation-in-part of pending U.S. patent application Ser. No. 463,999, filed Feb. 4, 1983, and issued on Oct. 15, 1985 as U.S. Pat. No. 4,547,166. That application was a continuation-in-part of then-pending U.S. patent application Ser. No. 417,554, filed Sept. 13, 1982, and issued Jan. 8, 1985 as U.S. Pat. No. 4,492,058, which itself was a continuation-in-part of then-pending U.S. patent application Ser. No. 233,495, filed Feb. 11, 1981, and now abandoned. The latter application was in turn a continuation-in-part of U.S. patent application Ser. No. 121,645, filed Feb. 14, 1980, and issued Dec. 22, 1981, as U.S. Pat. No. 4,306,375.

BACKGROUND

1. FIELD

This invention is in the field of toy vehicles, and particularly relates to self-powered miniature toy vehicles capable of negotiating in water as well as on very steep and irregular surfaces.

2. PRIOR ART

An amphibious toy vehicle offered at one time by the Eldon Company had the capability of operation on rough surfaces or in water. This vehicle was driven by a battery-powered mechanism and had a separate screw drive for propulsion in water. The screw was fixed in its driving direction relative to the vehicle chassis.

Many water-play toys have been made to resemble boats or water creatures and to propel themselves along the surface of a body of water. Some of these toys depended for propulsion (but not to any significant extent for flotation) upon rotating wheels or other rotating elements rotatably fixed to the sides of the toys. For example, the Tomy Company has offered bathtub toys configured as toy penguins, fish, dolphins, frogs, and so forth, which float and whose limbs rotate to propel them. The same company has offered bathtub toys configured as toy paddlewheel boats, with lateral, rotatably fixed propulsive paddlewheels.

These toys are all made for water use exclusively, rather than for amphibious use. In the case of the paddlewheel toys, it does not appear that the paddlewheels would both at the same time touch a surface on which the toys were placed, and, even if they would, neither the paddlewheels nor the toy bodies generally were suitably configured to provide good traction or effective operation over rough surfaces. In the case of the rotating-limb toys, the dynamic visual effect of such toys operating on a dry surface would be to lurch forward erratically, producing—at best—generally a comic or silly impression.

All of these tub toys may well be adequate for their intended purposes. They would not be suitable for a toy amphibious vehicle that is intended to suggest the operation of a real amphibious vehicle—e.g., a swamp buggy or a military amphibious carrier. Such a real vehicle should operate very tenaciously and effectively over rough surfaces as well as operate in water, to produce an exciting, "adventure" kind of impression rather than one that is comic or silly.

BRIEF SUMMARY OF THE INVENTION

Our invention provides a self-propelled amphibious miniature toy vehicle for operation along the surface of a pool of water and also on an extremely steep, irregular nonwater surface.

The vehicle has wheel means that contribute to propulsion along both kinds of surfaces; the wheel means also contribute to flotation during operation in water. In certain preferred embodiments of our invention the vehicle also has a steerable water jet that contributes to propulsion along a water surface; in addition, the water jet steers the vehicle. This combination of triple-purpose wheel means with a dual-purpose water jet provides an unusually versatile toy with a large number of modes of use.

In particular, when the toy is operated on a water surface, the steerable water jet interacts with the propulsive and buoyant wheel means to make the amphibious vehicle perform differently in the water than it does on a nonwater surface. An example will clarify this point.

If the jet is pointed to steer the vehicle to one side or the other in water, the vehicle can be (for example) started out on a dry surface a considerable distance from a pool of water, but pointed toward the pool. The vehicle will move in a substantially straight trajectory toward the pool, climbing over even very steep and irregular obstacles and surfaces in doing so.

After it enters the pool, however, the vehicle will begin to move in a substantially or generally circular trajectory, tending to keep it within the pool if the pool is large enough in comparison with the angle of the jet. Alternatively, if the jet is pointed at a relatively shallow angle to the "straight ahead" direction of the vehicle, the vehicle will leave the pool at a particular point (determined in advance, to some degree, by the setting of the jet) and will again commence to move in a substantially straight trajectory.

As yet another alternative, if the jet is pointed to steer the vehicle substantially straight ahead in operation on a water surface, then the vehicle will move forward more rapidly than it would if propelled solely by the wheels, in the absence of the jet.

Furthermore, we prefer to make the wheel means disengageable from the motor so that the vehicle can be operated in a neutral or "freewheeling" mode on land—and yet will be self-propulsive in water due to the action of the water jet alone.

The vehicle is used with some means for providing electrical energy to power the vehicle; we refer to these means as "electrical battery means."

When such "battery means" are in use with the vehicle, the vehicle has major weight components positioned to provide a generally symmetrical and balanced arrangement. This constraint may be in a certain sense regarded as the context in which our invention operates. As further discussed below and as defined by the appended claims, however, with respect to some of the preferred embodiments of our invention this constraint is also part of the invention itself.

Our invention has a frame, substantially overscale hollow "wheel means" mounted to the frame for rolling rotation, and an electric motor mounted to the frame and operatively connected to draw power from the battery means and to drive at least one of the "wheel means.38 The invention also has some means for releasably supporting the electrical battery means.

We intend the phrase "wheel means" to encompass not only wheels but various forms and types of tires, cleating, paddling structures, half-track- or tank-style endless belts, and/or even skids at one end in combination with rotary driving structures at the other. The wheel means are mounted to the chassis for rolling rotation (of at least some member, such as the driving rollers in the case of a half-track belt) about at least one laterally extending axis.

In the instance of relatively more conventional wheel means, the wheel means have more than one such axis—generally, mutually parallel but spaced-apart front and rear axes. In this instance the wheel means comprise substantially overscale hollow front wheel means and substantially overscale hollow rear wheel means.

Whether present at both front and rear or not, the wheel means extend below the frame to effect propulsion of the vehicle along a nonwater surface when the vehicle is placed on such a surface. The volume-to-weight ratio of each of the wheel means themselves, however, is sufficiently high that when the vehicle is placed in water the wheel means contribute significantly to flotation of the vehicle.

We prefer to provide cleated tires mounted to the wheel means. The cleats should be adapted and sufficiently pronounced to propel the vehicle along a water surface—provided that generally the bottom half of each wheel means is submerged in the water and generally the top half of each wheel means is above the water. The overall flotation characteristics of the vehicle are, accordingly, made such that when the vehicle is placed in a sufficiently deep pool of water the vehicle floats just that way—i.e., with very generally the bottom half of each wheel means submerged and very generally the top half of each wheel means above the water.

Certain preferred embodiments of our invention have an impeller rotatably mounted to the frame and disposed for immersion in water when the vehicle is in operation along a water surface. The impeller has an intake side and an exhaust side.

As will be seen, the impeller may be provided in the form of a plurality of vanes disposed in a circular array about a generally open center, with the vanes oriented to take in water from the center and exhaust the water toward the periphery of the array (when the impeller is rotated in a particular sense). If the impeller is in this form, of course, the intake "side" of the impeller takes the form of a central intake zone.

In the forms of our invention that have an impeller, there is also an impeller housing mounted to the frame and disposed to guide the water from the pool to the intake side of the impeller. The housing is also disposed to guide the water from the exhaust side of the impeller as a water jet back into the pool, to aid in propelling the vehicle.

At least part of the impeller housing is manually rotatable relative to the frame, to point the exhaust jet in a desired direction—to control the vehicle's trajectory.

The forms of our invention now under discussion also include some means for driving the impeller. These means are rotatably mounted to the frame and powered from the motor.

A particularly preferred form of our invention makes use of a worm-and-worm-gear drive that includes a pinion gear mounted to and driven by an output driveshaft of the motor, a worm rotatably mounted to the frame and powered from the pinion, and a worm gear rotatably mounted to the frame. The worm gear is meshed with and directly driven from the worm, and it drives at least one of the wheel means.

The impeller-driving means, when present, are also powered from the pinion. It is particularly advantageous that the impeller-driving means comprise an impeller gear mounted to the impeller, to rotate with the impeller, and an extension of the pinion gear, mounted to engage and drive the impeller gear. With this configuration of parts the water jet and the driven wheel means are powered from the pinion in common through a small number of moving parts. They are also, however, powered at different speeds to accommodate the differing drive-speed requirements of a water jet and wheel means.

In this connection it will be understood that for wheeled operation on a nonwater surface the various forms of wheel means all operate in a very positive engagement with the surface on which the vehicle moves. Accordingly they all require a relatively large speed reduction from an ordinary small electric motor, to provide the necessary mechanical advantage as well as the proper speed.

On the other hand a water-jet impeller engages the water medium in a far less positive fashion with a great deal of "slippage," to generate the jet. Furthermore the generation of the jet is only the first stage. At the second stage, the propulsive action of the resulting jet is only that due to the conservation of momentum (which is a quite small effect in these circumstances) added to the pressure against the nearby water; additional "slippage" is involved at this stage. Accordingly much higher impeller speeds and lower speed reductions are appropriate.

To provide disengagement of the driven wheel means from the motor as previously mentioned, we prefer to position the worm gear on the axle of the driven wheel means: the worm gear rotates with the axle, but is mounted for sliding motion along the axle. The worm gear is manually slidable along the axle into and out of engagement with the worm.

In preferred embodiments of our invention, as stated earlier, the weight distribution of the parts of the toy vehicle is to be considered an important feature or element of our invention. The following nine paragraphs elaborate on these features.

First, the frame defines a chassis with upright walls, and the chassis walls in turn define an interior compartment. Second, the wheel means are hollow wheel means mounted to the chassis for rolling rotation about respective mutually parallel spaced-apart front and rear axes.

Third, the electrical motor is mounted in the interior compartment.

Fourth, the vehicle also is provided with some means for electrically connecting the battery means, when the latter are in place, to the motor—so that the battery means power the motor.

Fifth, transmission means are mounted in the interior compartment. These means include a speed-reduction mechanism connecting the motor driveshaft to both the front wheel means and the rear wheel means, to transmit rotation from the driveshaft to the wheel means. This mechanism is made to effect this transmission with reduced speed and increased power—i.e., with a mechanical advantage between the motor shaft and wheel means. We have found that a high value of mechanical advantage—for example, between 55:1 and 65:1—is particularly preferable. A mechanism at each end of the motor using a worm and worm gear is especially wellsuited to this purpose, because it provides an unusually high value of mechanical advantage with a minimum of moving parts.

Sixth, at least major portions of these major weight components—the transmission means, the motor, and the battery means when in place—are at about the same height as the front and rear wheel means.

We have found that observing this last-mentioned constraint upon our toy vehicle configuration tends strongly to provide a remarkably effective climbing-toy operation. Although the climbing-toy operation may be somewhat less extraordinary than that obtained by also requiring that all of the major weight components substantially fully occupy the interior compartment, as in our earlier-mentioned patents, nevertheless the performance is quite excellent.

The characteristics of climbing-toy operation have been described at length in our earlier-mentioned U.S. Pat. No. 4,306,375. Briefly, however, these characteristics encompass the ability to negotiate steep and irregular surfaces without tipping over—either backward or sideward.

By carrying the height constraint into the configuration of an amphibious toy vehicle, we have been able to obtain the new result of an amphibious vehicle which can propel itself along the surface of a pool of water and which, upon emerging from such a pool and without the necessity for any adjustments or new control settings—can proceed to operate as a climbing toy. This result presents to the user of such toy vehicles (generally a child) a striking and extremely appealing overall effect.

When the constraint just discussed is combined with certain other features of our invention previously discussed, the impact of the toy is further enhanced.

In addition it is beneficial to provide a toy vehicle body that is mounted to the frame. The body advantageously conceals the motor, worms, worm gears, and dry-cell mounting means (as well as the dry cell itself, when the latter is in place), and is a fantasy design or a scale model derived from at least one real vehicle body. The vehicle-body scale used should be such that the axle spacing turns out to match the spacing between the axes of wheel-means rotation of the toy. The outside diameter of the tires, however, should be substantially overscale—for example, two to three times overscale—to produce an exaggerated effect of power and traction as well as to help supply the buoyancy or flotation capability discussed previously.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 is a perspective view of the FIG. 1 embodiment, shown operating upon a toy terrain that is suitable for being filled or partly filled with water to exercise some of the amphibious capabilities of the invention. It is to be understood that in this drawing the terrain is shown relatively small, in comparison with the size of the vehicle, only for the sake of clarity in illustration; and that a larger toy terrain (or actual terrain) will more fully exploit the amphibious capabilities of the invention.

FIG. 4 is a similar side elevation as in FIG. 3 but showing the terrain partly filled with water and the FIG. 1 embodiment operating along the surface of the water.

FIG. 5 is a plan view of the FIG. 1 embodiment, but without the battery or mechanism cover.

FIG. 6 is a side elevation of the FIG. 1 embodiment, taken along the line 6—6 of FIG. 5.

FIG. 7 is a longitudinal section, taken along the line 7—7 of FIG. 5, showing the water-jet impeller mechanism and drive system. For convenience the impeller housing is also shown in longitudinal section through its centerline, with the jet pointed straight backward along the vehicle's longitudinal axis.

FIG. 8 is a bottom view of the impeller itself.

DETAILED DESCRIPTION OF THE PREFERRED EMBODIMENTS

Figure 1:
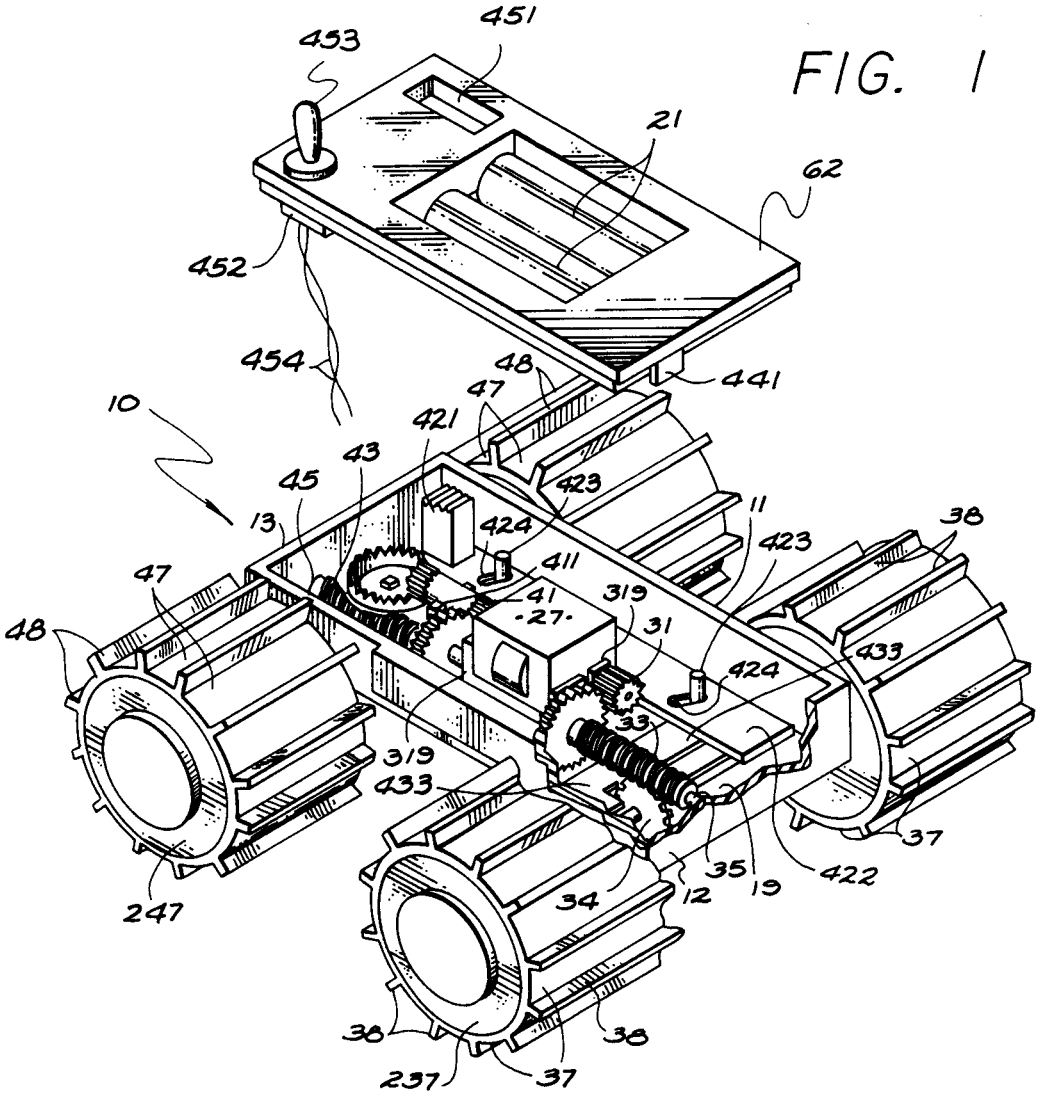
FIG. 1 is a perspective view, partly broken away, of a preferred embodiment of our invention with a battery in place, and with a mechanism cover (which includes the battery support means) shown removed to illustrate the internal parts.

As shown in FIGS. 1, 5, 6 and 7, a preferred embodiment of our invention is built in and around a chassis 10 consisting of upstanding left and right side walls 11, front end wall 12 and rear end wall 13, all erected about the periphery of an extended horizontal floor 19. The front and right-side walls 12 and 11 are shown partly broken away in FIG. 1 for a clearer view of the internal mechanism.

The front end wall 12 may have a protrusion (not shown) which supports and contains functional connections for a small light bulb, and which also supports a transparent light distributor, all as illustrated and described in detail in the previously mentioned U.S. Pat. No. 4,306,375.

The chassis 10 serves both as a frame to support and as a partial enclosure to conceal and protect the power source and train.

Mounted below the chassis for rolling rotation with respect to it are two mutually parallel but spaced-apart axles, an axle 36 near the front and an axle 46 near the rear of the chassis. Secured to the ends of these two axles 36 and 46 are respective pairs of wheels—front wheels 237 and rear wheels 247, with corresponding tires 37 and 47, which are thus in effect mounted to the frame for rolling rotation about respective mutually parallel but spaced-apart axes (the centerlines of the axles 36 and 46), one such axis being in front of the other.

Mounted atop the chassis floor 19 at a position between the two axles (or wheel rotation axes) is an electric motor 27. The motor 27 is centrally located relative to the side walls 11, and oriented so that its driveshaft 283 (FIG. 5) is perpendicular to the two wheel-rotation axes. This motor is of a type whose driveshaft extends both fore and aft from the motor housing. The motor 27 is secured against longitudinal motion by two blocks 319, which are integral with the chassis floor 19 and the adjacent side wall. A motor cover (not shown) is advantageously provided to keep the motor in place and to keep it dry in case water enters the chassis 10.

Mounted to the two ends of the motor driveshaft 283 are respective drive pinions 31 at the front and 41 at the rear, which are firmly secured for rotation with the driveshaft.

Next to the pinions 31 and 41 and meshed with them are respective spur gears 32 and 42, which rotate on corresponding shafts 35 and 45 oriented parallel to the driveshaft. The spur-gear shafts 35 and 45 are each journalled at one of their respective ends into one of the motor blocks 319, and at the other of their respective ends into the corresponding end wall 12 or 13, in a manner to be detailed below.

Sharing the spur-gear shafts 35 and 45 with the spur gears 32 and 42, and firmly secured to those spur-gear shafts to rotate with them, are respective worms 33 and 43. (The latter is drawn partially broken away in FIG. 1, for a more complete view of the crown gear, which is discussed below.) It is to be understood that each spur-gear-and-worm combination may be constructed as an integrally formed spur-gear-and-worm-and-shaft component, or as a spur-gear-and-shaft component with the worm keyed to the shaft, or as a worm-and-shaft component with the spur gear keyed to the shaft, etc.

Below these worms 33 and 43, and oriented and disposed to mesh with them, are respective worm gears 34 and 44—each oriented to rotate about axes parallel to the axes of wheel rotation. The worm gears 34 and 44 and the respective wheel pairs 237 and 247 are mounted conaxially (that is, together on the same respective shafts 36 and 46). The gears and wheels are fixed to their corresponding axles, for rotation in common; thus each of the worm gears 34 and 44 drives a respective pair 237 or 247 of wheels.

In this way the wheels may be driven by a symmetrical power train having but two stages and yet providing very high mechanical advantage between the motor driveshaft and the axle.

Mounted for rotation near the rear end of the floor 19 is a crown gear 408 (FIGS. 5 through 7). The crown gear is keyed to the top end of a short vertical shaft 407 that passes through the floor 19. Fixed to the bottom end of the shaft 407 below the floor is an impeller 405, 406 comprising vanes 406 (FIGS. 7 and 8) in a substantially circular array. The intake side of the impeller array is the central area 414 (FIG. 8) within the array, and the exhaust side is the periphery 415 of the array. When the impeller 405, 406 is immersed and the array spins counterclockwise (as viewed from below, as illustrated in FIG. 8) the angled vanes 406 force water from the intake area 414 through the spaces 405 between the vanes 406 to the exhaust side 415.

The crown gear 408 spins the impeller array through the vertical shaft 407, being driven by an extension 412 of the rear pinion 41. The rear end of the pinion extension 412 is formed into or secured to an auxiliary pinion 413, which engages the crown gear 408. A circularly notched boss 411 holds the rear end of the extension 412 at the same height above the floor as the front end.

Mounted for manual rotation to the underside of the floor 19 is an impeller housing 400 that closely encloses the impeller 406, 405. The housing rides in a circular vertical groove in the underside of the floor 19, and is retained by flange tabs 416 that snap into a lateral groove formed in the side wall of the vertical groove.

The impeller housing 400 has a peripheral wall 417 that closely encloses the impeller vanes 406, except in one small area where an output nozzle 401 is formed. Within the nozzle 401, a duct 404 provides water communication between the peripheral exhaust side of the impeller and the environment—i.e., the pool of water in which the vehicle is typically floating during aquatic operation. The impeller housing 400 also has a bottom wall 402 that is closely adjacent to the underside of the impeller vanes 406, except at an intake aperture 403 formed in the center of the bottom wall 402. The intake aperture 403 provides communication between the environment and the central intake area 414 of the impeller 405, 406.

Since the impeller spins much more rapidly than the wheels, for proper operation, a much smaller stepdown from an ordinary battery-powered electric motor is required for the impeller shaft 407 than for the axles 36, 46. For example, the stepdown from the motor driveshaft 283 to the impeller shaft 407 may be in the range of only 2.5:1 to 3.5:1.

As previously mentioned the front worm gear 34 is manually slidable along the front axle 36 to disengage that worm gear 34 from the front worm 33. A shifting fork 433 slides laterally just above the floor 19 to move the front worm gear 34 into or out of engagement with the front worm 33. A similar arrangement (not shown in detail) is provided for the rear worm gear 44: it is shifted laterally by a shifting fork 443 that also slides laterally just above the floor 19.

Both of the shifting forks 443 and 433 are driven in common from a shifting bar 422 that slides longitudinally just above the shifting forks. The shifting bar 422 is constrained to slide longitudinally by screws 432 mounted in the floor 19; the screws pass through longitudinal guide slots 431 in the shifting bar 422. User convenience in manipulating the shifting bar 422 is ensured by provision of an upstanding handle 421, whose top end is knurled. This shifting handle 421 is accessible through—and if desired may be made to project upwardly through—a port 451 in the mechanism cover 62.

The shifting forks too are constrained to slide only in one direction—but laterally—by virtue of being positioned in shallow slots (not illustrated) in the floor 19. Vertical shifting pins 423 are mounted to the shifting forks 433 and 443; these shifting pins 423 pass through diagonal slots 424 in the shifting bar 422.

When a user of the toy manually slides the shifting bar longitudinally, the edges of the diagonal slots 424 bear against the shifting pins 423. The shifting pins cannot move longitudinally with the shifting bar 422, since the pins are mounted to the shifting forks 433, 443—and as previously mentioned the forks can only move laterally. Since, however, the slots 424 are diagonal, while themselves moving longitudinally they exert a lateral component of force on the shifting pins 423. The pins in turn move the forks 433, 443 laterally to shift the worm gears 34, 44 into or out of engagement with the worms 33, 43 as desired.

Figure 3:
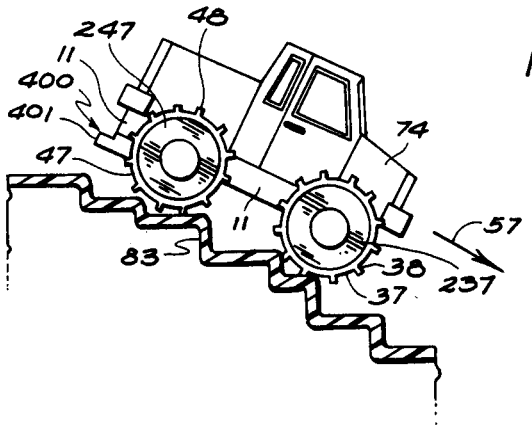
FIG. 3 is a side elevation, with the terrain shown in section, of the same scene as in FIG. 2.

A scale-model vehicle body (such as 74 in FIGS. 2 through 4) is fitted to the chassis 10, and held on by appropriate detents formed in the outsides of the chassis walls 11 and/or 12 and 13. The body 74 snaps on and off to permit easy changing of the battery 21. The body style typically is derived from a real vehicle body, with some adjustment of proportions to fit the chassis.

To obtain excellent traction on irregular surfaces and to permit locomotion of the vehicle in water, the tires 37 and 47 are made of resilient rubber or plastic, configured with extremely exaggerated or pronounced cleats such as 38 and 48.

Some details of the construction of this preferred embodiment of our invention include protective drive-gear wells, such as the rear well 73, encasing the worm gears 34 and 44 respectively; and the drive-mechanism cover 62. The drive-gear wells must be wide enough to accommodate the lateral shifting of the worm gears. The cover 62 protects the worms 33, 43, and worm gears 34, 44, and the pinions 31, 41, and the pinion extension 412, 413 and the crown gear 408 against damage when the user installs or changes a battery.

The cover also has a formed recess for the batteries 21, and within that recess carries contacts (not illustrated) for electrical connection of the batteries when present to a switch 452. The switch has a handle 453 that is accessible above the cover 62. Both the switch handle 453 and the shifting-bar handle 421 are also accesible through the vehicle body 74. Electrical connection from the batteries and switch to the motor 27 is provided by wires 454, through conventional connections (not illustrated) at the motor 27.

An auxiliary cover (not illustrated) is advantageously provided to close the battery-compartment recess in the mechanism cover 62.

The forward end of the forward worm shaft 35 rests in a half-journal formed in the horizontal bottom surface of a slot 15 in the forward wall 12. Likewise the rearward end of the rear worm shaft 45 rests in a half-journal formed in the horizontal bottom surface of a slot 17 in the rearward wall 13. The front end of the front worm shaft 35 is retained in position by a tab 441 that projects downwardly from the underside of the mechanism cover 62. Similar downwardly depending tabs (not shown) retain the rear end of the front worm shaft 35, both ends of the rear worm shaft 45, and both ends of the pinion extension 412 in their respective positions.

Though below the chassis floor proper 19, the axles 36 and 46 are within the chassis enclosure by virtue of axle wells 19W (FIG. 6), which extend to the two sides of the chassis and serve as axle bearings.

As best shown in FIG. 5, each wheel (such as the front wheel 237) is formed as a hollow toroidal structure, preferably (for maximum volume) squared off with outboard annular planar surface 237, inboard annular planar surface 337, an interior annular generally cylindrical surface 342, and an exterior annular generally cylindrical surface 343.

The tires 237 and 247 are substantially "overscale"—that is, oversize with respect to the otherwise generally consistent model body and wheelbase.

Due to the very pronounced cleats 38 and 48, the vehicle can find a grip on all but the slipperiest surfaces, even on very steep grades; and due to the high mechanical advantage of the drive train will climb virtually any surface it can rest on and grip.

It will be understood that the foregoing disclosure is intended to be merely exemplary, and not to limit the scope of the invention—which is to be determined by reference to the appended claims.

We claim:

1. A self-propelled amphibious toy vehicle for operation along the surface of a pool of water and on a steep, irregular nonwater surface; said vehicle having wheel means that contribute to propulsion along both such surfaces and that contribute to flotation during operation along the surface of such pool of water, and said vehicle also having a steerable water jet that contributes to propulsion of the vehicle along such water surface and that steers the vehicle; said vehicle being for use with electrical battery means, and comprising:

a frame;

hollow wheel means comprising substantially overscale hollow front wheel means and substantially overscale hollow rear wheel means mounted to the frame for rolling rotation about respective mutually parallel but spaced-apart front and rear axes, and extending below the frame to effect propulsion of the vehicle along such a water surface and along such a steep, irregular nonwater surface, the volume-to-weight ratio of each of said wheel means being sufficiently high to contribute significantly to flotation of the vehicle in water;

cleated tires mounted to the wheel means, the cleats being adapted and sufficiently pronounced to propel the vehicle along such a water surface when generally each wheel means is partly submerged in such water;

an electric motor mounted to the frame and operatively connected to drive at least one of the wheel means;

means mounted to the frame to releasably support such electrical battery means and to electrically connect such battery means to power the motor;

an impeller rotatably mounted to the frame and disposed for immersion in such water when the vehicle is in operation along such a water surface, the impeller having an intake side and an exhaust side;

an impeller housing mounted to the frame and disposed to guide such water:

from such pool to the intake side of the impeller, and from the exhaust side of the impeller as a water jet back into such pool, to aid in propelling the vehicle;

at least part of the impeller housing being manually rotatable relative to the frame, to point the exhaust jet in a desired direction so as to control the vehicle's trajectory; and means, rotatably mounted to the frame and powered from the motor, for driving the impeller;

an output driveshaft that forms a part of the motor;

a pinion gear mounted to and driven by the driveshaft;

a worm rotatably mounted to the frame and powered from the pinion;

a worm gear rotatably mounted to the frame, and meshed with and directly driven from the worm, and driving at least one of the wheel means; and the impeller driving means also being powered from the pinion.

2. The toy vehicle of claim 1, wherein the impeller-driving means comprise:

an impeller gear mounted to the impeller for rotation therewith; and an extension of the pinion gear, mounted to engage and drive the impeller gear;

whereby the water jet and said at least one of the wheel means are driven from the pinion in common through a small number of moving parts, but at different speeds to accommodate the differing drive-speed requirements of a water jet and a wheel means.

3. The toy vehicle of claim 2, wherein:

the impeller gear is a crown gear coaxial with the impeller.

4. The vehicle of claim 2, wherein:

said at least one driven wheel means are mounted to the frame by means of a corresponding axle that rotates with the driven wheel means;

the worm gear is mounted to the axle for rotation with the axle and for sliding motion along the axle; and the worm gear is manually slidable along the axle into and out of engagement with the worm.

5. The toy vehicle of claim 4, wherein:

the impeller comprises a plurality of vanes disposed in a substantially circular array about a generally open center, the vanes being oriented to take in such water from the center and exhaust such water toward the periphery of the array, when the impeller is rotated in a particular sense; and the impeller housing defines:

a central aperture that is disposed adjacent to the center intake of the array of vanes, and a peripheral enclosure surrounding the periphery of the array, except for an exhaust aperture in the enclosure;

the exhaust aperture being manually rotatable with respect to the frame, to point the exhaust jet in a desired direction so as to control the vehicle's trajectory.

6. The vehicle of claim 5, for use with electrical battery means that comprise a dry-cell battery; said vehicle having, when such battery means are in use therewith, major weight components positioned to provide a generally symmetrical and balanced arrangement; wherein:

the frame defines a chassis having upright walls defining an interior compartment;

the electric motor is mounted in the interior compartment; and at least major portions of the pinion gear, worm gear, and impeller-driving means, the motor, and such battery means, when such battery means are supported in the supporting means, being at approximately the same height as the front and rear wheel means;

whereby the vehicle is stable in operation even when driven along such water surface and even when driven along such steep, irregular nonwater surface.

7. The toy vehicle of claim 6, wherein:

the motor driveshaft is oriented parallel with the direction of propulsion of the vehicle on such nonwater surface, and extends out of the motor at two opposite ends of the motor, both forwardly and rearwardly with respect to the direction of propulsion of the vehicle;

a duplicate pinion, worm, and worm gear are provided at each end of the vehicle, driven by the respective ends of the driveshaft.

8. A self-propelled amphibious toy vehicle for operation along the surface of a pool of water and on a steep, irregular nonwater surface; said vehicle having major weight components positioned to provide weight in a generally symmetrical and balanced arrangement so that said vehicle is stable in operation even when driven along such water surface and even when driven along such steep, irregular nonwater surface; said vehicle being for use with electrical battery means that comprise a dry-cell battery; said vehicle having, when such battery means are in use therewith, major weight components positioned to provide a generally symmetrical and balanced arrangement; and comprising:

a frame in the form of a chassis having upright walls defining an interior compartment;

hollow wheel means comprising hollow front wheel means and hollow rear wheel means mounted to the frame for rolling rotation about respective mutually parallel but spaced-apart front and rear axes, and extending below the frame to effect propulsion of the vehicle along such a water surface and along such a steep, irregular nonwater surface, the volume-to-weight ratio of each of said wheel means being sufficiently high to contribute significantly to flotation of the vehicle in water;

cleated tires mounted to the wheel means, the cleats being adapted and sufficiently pronounced to propel the vehicle along such a water surface when generally the bottom half of each wheel means is submerged in such water and generally the top half of each wheel means is above such water; and wherein the overall flotation characteristics of the vehicle are such that when the vehicle is placed in a sufficiently deep pool of water the vehicle floats with generally the bottom half of each wheel means submerged in such water and generally the top half of each wheel means above such water;

an electric motor that is mounted to the frame, within the interior compartment, and that has a driveshaft which extends from the motor and which is operatively connected to drive at least one of the wheel means, said at least one of the wheel means being mounted to the frame by means of a corresponding axle which is positioned at the corresponding axis of that wheel means and which rotates with that wheel means;

means mounted to the frame to releasably support such electrical battery means;

said frame, said motor and said battery means when supported in the support means not protruding any appreciable distance below the level of said front and rear axes in the area between said front and rear wheel means;

means for electrically connecting such battery means, when supported in the supporting means, to the motor, so that the battery means power the motor;

a pinion gear mounted to and driven by the driveshaft;

a worm rotatably mounted to the frame and powered from the pinion;

at least major portions of the motor, the pinion gear, the worm, and such battery means, when such battery means are supported in the supporting means, being at approximately the same height as the front and rear wheel means; and a worm gear that is rotatably mounted to the axle for rotation with the axle and for sliding motion along the axle, and that is meshed with and directly driven from the worm, and that drives said at least one of the wheel means, and that is slidable along the axle into and out of engagement with the worm;

whereby the vehicle is stable in operation even when driven along such water surface and even when driven along such steep, irregular nonwater surface.

9. The toy vehicle of claim 8, wherein:

the motor driveshaft is oriented parallel with the direction of propulsion of the vehicle on such nonwater surface, and extends out of the motor at two opposite ends of the motor, both forwardly and rearwardly with respect to the direction of propulsion of the vehicle;

duplicate sets of the pinion, the worm, and the worm gear are provided at each end of the vehicle, and are driven by the respective ends of the driveshaft.

* * * * *